US010832644B2

(12) United States Patent
Fiden et al.

(10) Patent No.: US 10,832,644 B2
(45) Date of Patent: Nov. 10, 2020

(54) PEDAL BOARD

(71) Applicant: DIGITAL MUSIC CORPORATION, Santa Rosa, CA (US)

(72) Inventors: Joshua C. Fiden, Occidental, CA (US); John L. Clark, Petaluma, CA (US)

(73) Assignee: DIGITAL MUSIC CORPORATION, Santa Rosa, CA (US)

( * ) Notice: Subject to any disclaimer, the term of this patent is extended or adjusted under 35 U.S.C. 154(b) by 386 days.

(21) Appl. No.: 15/407,926

(22) Filed: Jan. 17, 2017

(65) Prior Publication Data

US 2017/0206879 A1 Jul. 20, 2017

Related U.S. Application Data

(60) Provisional application No. 62/280,989, filed on Jan. 20, 2016.

(51) Int. Cl.
*G10D 9/00* (2020.01)
*G10H 1/34* (2006.01)

(52) U.S. Cl.
CPC ..... *G10H 1/348* (2013.01); *G10H 2210/155* (2013.01); *G10H 2230/035* (2013.01); *G10H 2240/201* (2013.01)

(58) Field of Classification Search
CPC ..... G10H 1/348; G10H 2210/155; G10H 2230/035; G10H 2240/201
USPC ..... 84/453
See application file for complete search history.

(56) References Cited

U.S. PATENT DOCUMENTS 5,166,467 A * 11/1992 Brown ..... G10H 1/348 84/715
6,459,023 B1 * 10/2002 Chandler ..... G10H 1/32 84/177
D781,954 S * 3/2017 Wilfer ..... D17/20
D815,682 S * 4/2018 Trifilio ..... D17/20
2016/0019877 A1 * 1/2016 Remignanti ..... G10H 1/0066 84/645
2016/0086591 A1 * 3/2016 McGinly ..... G10H 1/32 84/453

FOREIGN PATENT DOCUMENTS

CA 2933473 A1 * 11/2014 ..... G10H 1/0058

OTHER PUBLICATIONS

Intheblues, Pedaltrain Jr (Junior) Pedalboard Unboxing & Setup, https://www.youtube.com/watch?v=Gh6A-nXpVA8 (Year: 2013).*
Big Music Australia, Boss ES-8 Effects Switching System | Product Demo, https://www.youtube.com/watch?v=fDxleqpg8lw (Year: 2015).*
(Continued)

*Primary Examiner* — Jianchun Qin
(74) *Attorney, Agent, or Firm* — Greenblum & Bernstein, P.L.C.

(57) ABSTRACT

A pedal board assembly includes a pedal board having a pedal board surface structured and arranged to support at least one effect pedal, and a removable pedal switching system. The pedal board includes a receiving area structured and arranged to accommodate the pedal switching system.

17 Claims, 18 Drawing Sheets

(56) References Cited

OTHER PUBLICATIONS

DC Gear Reviews, Accel FX22 Command Center Pedalboard Effects Pedal Switcher Review and Demo, screen captures of a YouTube video clip as 11 pages, published on Dec. 28, 2015 at https://www.youtube.com/watch?v=VTYgsA6KSRA.†

Accel Audio, FX22 Command Center Switcher / Looper Pedal Board, screen capture of a webpage and an image of the underside of the pedal board as 2 pages, published at least as early as Jan. 2, 2016, archived at https://web.archive.org/web/20160102225449/http://accelaudio.com:80/programmable-loopers/fx22-command-center-switcher-looper-pedal-board.†

Accel Audio, FX22 Command Center, screen captures of a YouTube video clip as 11 pages, published on Jan. 9, 2016 at https://www.youtube.com/watch?v=MlyAJN4L5Bo.†

* cited by examiner
† cited by third party

PEDAL BOARD

CROSS-REFERENCE TO RELATED APPLICATION

The present application claims the benefit of U.S. Provisional Application No. 62/280,989, filed Jan. 20, 2016, the content of which is expressly incorporated herein by reference in its entirety.

FIELD OF THE DISCLOSURE

The present disclosure relates to pedal boards for accommodating effects pedals (e.g., guitar effects pedals), and pedal board assemblies including a pedal board, a power supply, and a switching system.

BACKGROUND OF THE DISCLOSURE

Pedal switching devices (e.g., true bypass audio switchers) are commonly arranged on a support surface (e.g., a pedal support surface) of a pedal board, which may reduce the amount of space on the support surface that can accommodate these effects pedals. For example, some pedal switching devices are relatively large (e.g., occupying a footprint the size comparable to that of a plurality of effects pedals).

Additionally, when a pedal switching device is arranged on a support surface of a pedal board (e.g., at the front thereof) it is oftentimes arranged at or towards the front of the pedal board to provide a user access to the bank of switches, to thus allow the activation of particular pedals (or loops (or combinations) of pedals). Due to the height of the pedal switching device arranged on the pedal board surface, however, the pedal switching device may impede access to effects pedals arranged behind and/or adjacent to the pedal switching device.

Accordingly, there is a need for an improved pedal board that can, for example, increase the amount of useable space on the support surface for accommodating effects pedals, while still providing accommodatability for a switching device that does not impede (or impedes to a lesser extent) access to pedals arranged on the support surface.

SUMMARY OF THE EMBODIMENTS OF THE DISCLOSURE

Aspects of the present disclosure are directed to an improved pedal board that can, for example, increase the amount of useable space on the support surface for accommodating effects pedals.

Aspects of the present disclosure are directed to a pedal board assembly, comprising a pedal board having a pedal board surface structured and arranged to support at least one effect pedal and a removable pedal switching system. The pedal board includes a receiving area to accommodate the pedal switching system.

In embodiments, the receiving area is at a front of the pedal board.

In further embodiments, the pedal board further comprises a rear support and, and the rear support together with the pedal switching system support the pedal board assembly on a supporting surface.

In some embodiments, the pedal board further comprises a support rib structured and arranged to support the pedal board surface.

In yet further embodiments, wherein the pedal board further comprises a rear surface having at least one opening structured and arranged for passing cabling there through.

In embodiments, the pedal board assembly further comprises at least one power supply having a socket, fastened to an underside of the pedal board such that the socket aligns with one of the at least one opening.

In further embodiments, the pedal board surface includes a plurality of openings structured and arranged for passing cabling there through.

In some embodiments, the openings have an obround shape.

In yet further embodiments, the openings comprise horizontally-aligned obround openings and vertically-aligned obround openings.

In embodiments, the pedal board has a pedal board width, and the pedal switching system has a pedal switching system width, and the pedal board width is approximately the same as the pedal switching system width.

In further embodiments, the pedal board assembly further comprises a front support structured and arranged to be accommodatable within the receiving area in place of the removable pedal switching system.

In some embodiments, the pedal switching system is arranged in the receiving area.

In yet further embodiments, the pedal switching system comprises a plurality of switches on an upper surface thereof, and a plurality of connection jacks on a rear surface thereof, and wherein when the pedal switching system is arranged in the receiving, area, the plurality of connection jacks are arranged underneath the pedal board surface.

In embodiments, the pedal board additionally comprises a connection area having through holes, wherein the pedal switching system comprises threaded holes arranged to cooperate with the through holes when the pedal switching system is arranged in the receiving area, and wherein the pedal switching system is fastenable to the connection area using the through holes and the threaded holes.

In further embodiments, the pedal board additionally comprises a connection area having through holes, and wherein the connection area is angularly arranged with respect to the pedal board surface.

In some embodiments, the pedal board includes the pedal board surface, a rear wall depending from a rear of the pedal board surface, a rear support extending from the rear wall and under the pedal board surface, a connection area extending from a front of the pedal board surface, and side walls extending from the sides of the pedal board surface.

In yet further embodiments, the pedal board surface, the rear wall, the support, the connection area and the side walls are formed contiguously.

Further aspects of the present disclosure are directed to a pedal board, comprising a pedal board surface structured and arranged to support at least one effect pedal, a rear wall depending from a rear of the pedal board surface, a rear support extending from the rear wall and under the pedal board surface, and structured and arranged to support a rear end of the pedal board, and a connection area extending from a front of the pedal board surface. A receiving area is underneath the connection area, and the receiving area is structured and arranged to accommodate a removable front support and, alternatively accommodate a removable pedal switching system.

In embodiments, the rear support is approximately parallel to the connection area.

Further aspects of the present disclosure are directed to a pedal board assembly, comprising a pedal board having a pedal board surface structured and arranged to support at least one effect pedal, a rear wall depending from a rear of the pedal board surface, a rear support extending from the rear wall and under the pedal board surface, a connection area extending from a front of the pedal board surface, and side walls extending from the sides of the pedal board surface, and a removable pedal switching system. The pedal board includes a receiving area at a front of the pedal board structured and arranged to accommodate the pedal switching system. The pedal board has a pedal board width, and the pedal switching system has a pedal switching system width, and the pedal board width is approximately the same as the pedal switching system width. The removable pedal switching system is fastenable in the receiving area using the connection area. The rear support together with the pedal switching system support the pedal board assembly on a supporting surface.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the disclosure in conjunction with the following exemplary and non-limiting drawings wherein.

DETAILED DESCRIPTION OF EMBODIMENTS OF THE DISCLOSURE

Figure 1:
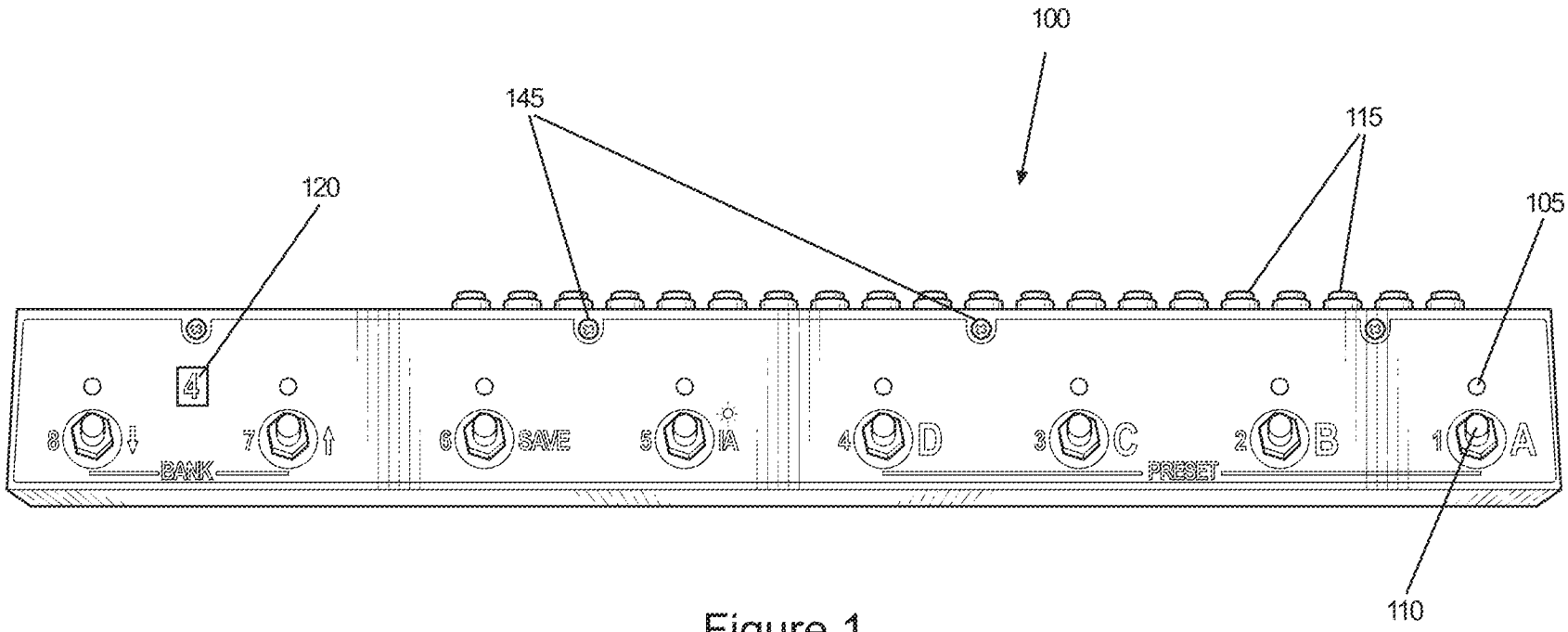
FIG. 1 is an exemplary pedal switching device in accordance with aspects of the present disclosure.

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, and any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately denoting a certain value is intended to denote a range within ±5% of the value. As one example, the phrase "about 100" denotes a range of 100±5, i.e. the range from 95 to 105. Generally, when the terms "about" and "approximately are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

FIG. 1 shows an exemplary pedal switching device 100 in accordance with aspects of the present disclosure. In embodiments, the pedal switching device 100 is an 8-loop true-bypass audio switcher that provides a user convenient, button-tap instant access to guitar effects pedals (which are connected to the pedal switching device) by actuating one or more effects loops. The pedal switching device may also include the ability to store preset loop combinations, send/receive MIDI commands, and/or be an integral part of a larger switching system. As shown in FIG. 1, the pedal switching device 100 may include a plurality of switches 110 (e.g., actuation switches and bank select switches), corresponding selection indicators 105, and a program indicator 120 (e.g., LED display) on a top surface thereof, and a plurality of jacks 1115 (e.g., ¼" jacks, MIDI jacks, and power sockets) on a backside thereof. The pedal switching device 100 may also include a plurality of fasteners 145 configured to secure elements (e.g., body and cover) of the pedal switching device 100 to one another.

Figure 2:
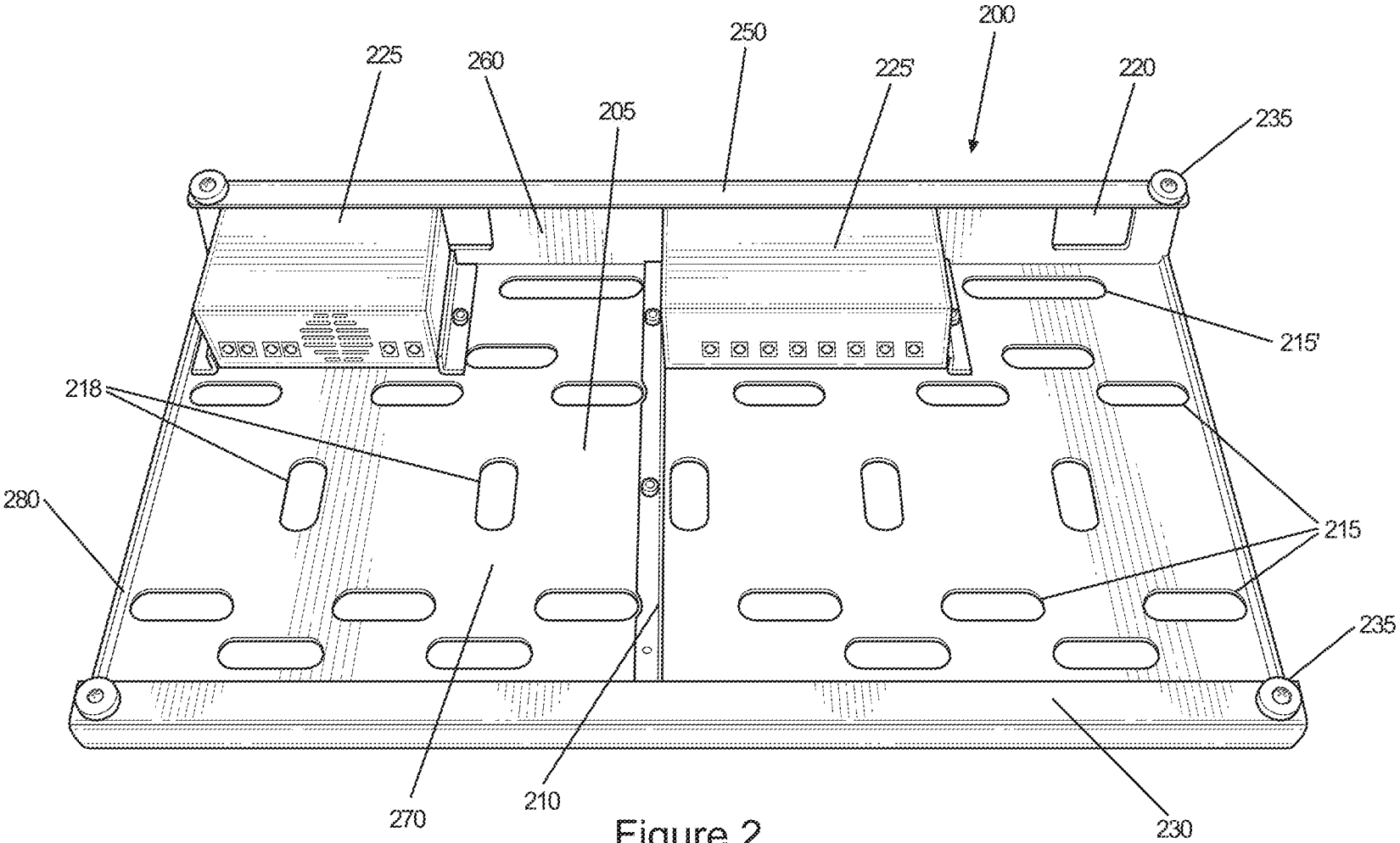
FIG. 2 illustrates a view of an underside of an exemplary pedal board assembly including a pedal board and power supply conditioners mounted thereto in accordance with aspects of the present disclosure.

FIG. 2 illustrates a view of an underside of a pedal board assembly 200 having a pedal board 205 and power supply conditioners 225, 225' mounted thereto in accordance with aspects of the present disclosure. As shown in FIG. 2, the exemplary pedal board 205 includes an approximately planar surface (top side not shown) configured for mounting effects pedals thereto, and holes 215, 218 in the approximately planar surface for routing cables (e.g., audio and/or power cables) between the top of the pedal board 205 and an underside 270 of the pedal board 205. As shown in FIG. 2, in embodiments, the holes include a plurality of horizontally-aligned obround holes 215 and a plurality of vertically-aligned obround holes 218. As can also be observed in FIG. 2, in certain embodiments, the pedal board 205 may also include a plurality of horizontally-aligned obround holes 215' having a longer length arranged towards a rear side of the pedal board 205.

The pedal board 205 includes a rear wall 260 having a plurality of openings 220 therein, which are structured and arranged to allow, for example, power cables to pass there through so as to connect with a power supply 225, 225'. The pedal board 205 includes a rear support 250 extending from the rear wall 260, and a plurality of feet 235 arranged on (e.g., fastened to) the rear support 250. In embodiments, the pedal board 205 also includes side walls 280 depending from the approximately planar surface. In embodiments, the rear wall 260, a rear support 250, and the side walls 280 may be formed contiguously with the approximately planar surface of the pedal board 205.

As also shown in FIG. 2, in embodiments, the pedal board assembly 200 includes at least one stiffening rib 210 (e.g., an L-shaped bracket) structured and arranged (e.g., fastened) on a bottom surface 270 of the pedal board 205, and configured to provide additional stiffness to the support surface of the pedal board 205 (which, in embodiments, may be a planar sheet of metal susceptible to bending). As also shown in FIG. 2, one or more power supplies 225, 225' (e.g., power conditioners) may be mounted to an underside 270 of the pedal board 205, wherein the stiffening rib 210 is also configured to securely fasten the one or more power supplies 225' to the pedal board 205. Thus, in embodiments, the stiffening rib 210 is operable to serve dual purposes for the pedal board 205 (e.g., providing additional stiffening and an attachment for power supplies).

As shown in FIG. 2, with this exemplary embodiment, the front end of the pedal board 205 includes a front cover thereon 230 having a plurality of feet 235 arranged thereon. In certain embodiments, this front cover 230 may be fixedly attached to the pedal board 205 (or formed contiguously with other elements (e.g., the approximately planar surface)

of the pedal board 205. In other embodiments, as described further below, the front cover 230 may be removable from a receiving area so that, for example, a switching device may be arranged in the receiving area, in accordance with aspects of the disclosure.

Figure 3:
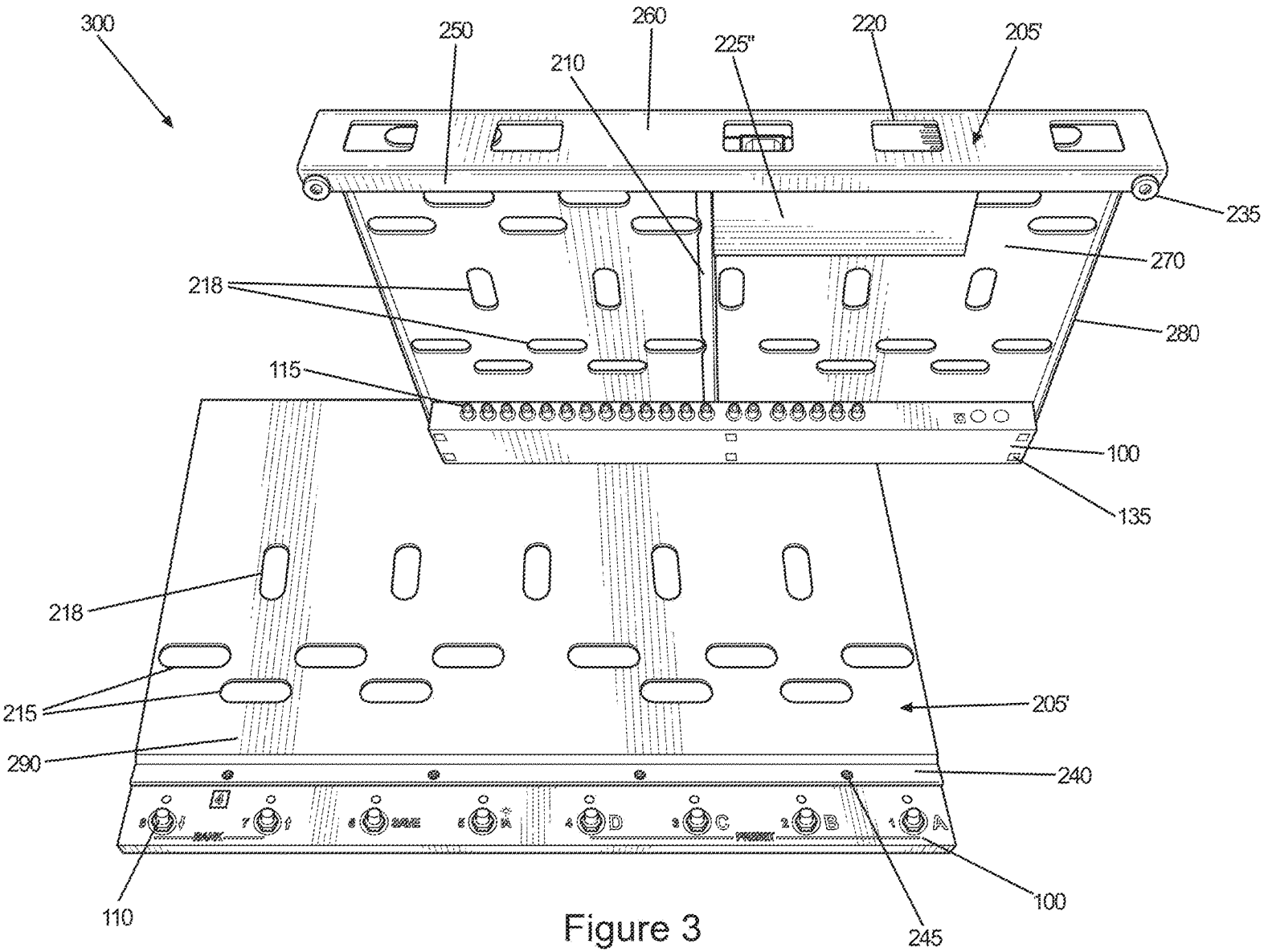
FIG. 3 illustrates views (underside and topside) of an exemplary pedal board assembly including a pedal board and a pedal switching device mounted to an underside thereof in accordance with aspects of the present disclosure.

FIG. 3 illustrates views (underside and topside) of a pedal board assembly 300 having a pedal board 205' and pedal switching device 100 mounted to an underside of the pedal board 205' in accordance with aspects of the present disclosure. As shown in the underside view, the switching device 100 is mounted to the pedal board 205' such that the jacks 115 are arranged towards a bottom side 270 of the pedal board 205'. By implementing these aspects of the disclosure, the jacks 115 and associated cabling (not shown) can be arranged remotely (e.g., on the bottom side of the pedal board 205') from the pedal supporting surface 290 (e.g., the top side of the pedal board 205').

The pedal board 205' includes a rear wall 260 having a plurality of openings 220 therein, which are structured and arranged to allow, for example, power cables to pass there through so as to connect with a power supply 225". As shown in FIG. 3, in accordance with aspects of the disclosure, the power socket of a power supply 225" is aligned with an opening 220 so as to allow power cables to pass there through so as to connect with the power supply 225". The pedal board 205 includes a rear support 250 extending from the rear wall 260, and a plurality of feet 235 arranged on (e.g., fastened to) the rear support 250. In embodiments, the pedal board 205 also includes side walls 280 depending from the approximately planar surface. In embodiments, the rear wall 260, a rear support 250, and the side walls 280 may be formed contiguously with the approximately planar surface of the pedal board 205'.

As shown in the topside view of FIG. 3, the pedal switching device 100 is attached (e.g., fastened) to the pedal board 205' such that the switches 110 are provided at a front end of the pedal board assembly 300. Moreover, an upper surface of the pedal switching device 100 is approximately flush with (or slightly below) the pedal support surface 290 so that interference with pedals (not shown) arranged on the pedal board assembly 300 can be minimized. The pedal switching device 100 includes a plurality of feet 135 arranged thereon, which are structured and arranged to support (e.g., off the ground) the pedal switching device 100, and together with feet 235, to support the pedal board assembly 300 off the ground and at a proper and level height. In embodiments, feet 235 may be fastened to the rear support 250 (e.g. using screws), and feet 135 may be fastened to the pedal switching device 100 (e.g. using screws or adhesive).

As also shown in FIG. 3, a connector 240 (e.g., attachment plate) may be used to attach the pedal switching device 100 to the pedal board 205'. In some embodiments, the connector 240 may be formed contiguously with the approximately planar surface of the pedal board 205'. In other contemplated embodiments, the connector 240 may be a discrete element configured to releasably connect to the pedal board 205' and the switching device 100.

In embodiments, the pedal switching device 100 may attach to the connector 240 with the above-noted fasteners 145 of the pedal switching device 100 through holes 245 in the connector 240 configured to correspond with the locations of the fasteners 145. As noted above, the connector 240 may be contiguous with the pedal support surface 290, or may be a separate element attached to the pedal board 205'. In embodiments, the connector 240 may be curved (in side view) to transition from the angled arrangement of the pedal board 205' to a surface approximately parallel to the ground, so that when the pedal switching device 100 is attached thereto, the pedal switching device 100 will also be arranged approximately parallel to the ground.

Figure 4:
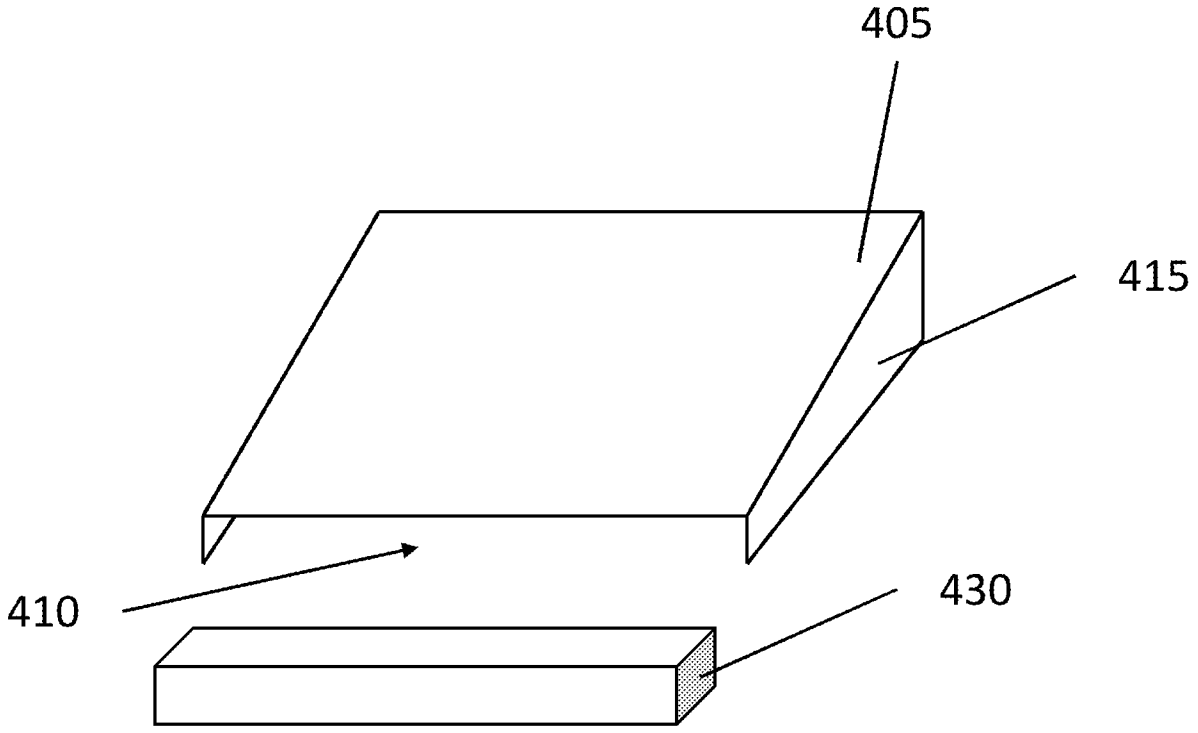
FIG. 4 illustrates a schematic perspective view of a pedal board configured to receive a pedal switching device in accordance with aspects of the present disclosure.

FIG. 4 illustrates a schematic perspective view of a pedal board 405 configured to receive a modular front-side element 430, e.g., either a front cover or a pedal switching device in accordance with embodiments of the present disclosure. As shown in FIG. 4, the pedal board 405 has a receiving area 410 configured (e.g., structured and arranged) to receive the modular front-side element 430, e.g., a pedal switching device or a front cover. As also shown in FIG. 4, with this exemplary embodiment, the pedal board 405 includes a plurality of side walls 415. In some embodiments, the side walls 415 may be contiguous with the pedal support surface of the pedal board 405.

Figure 5:
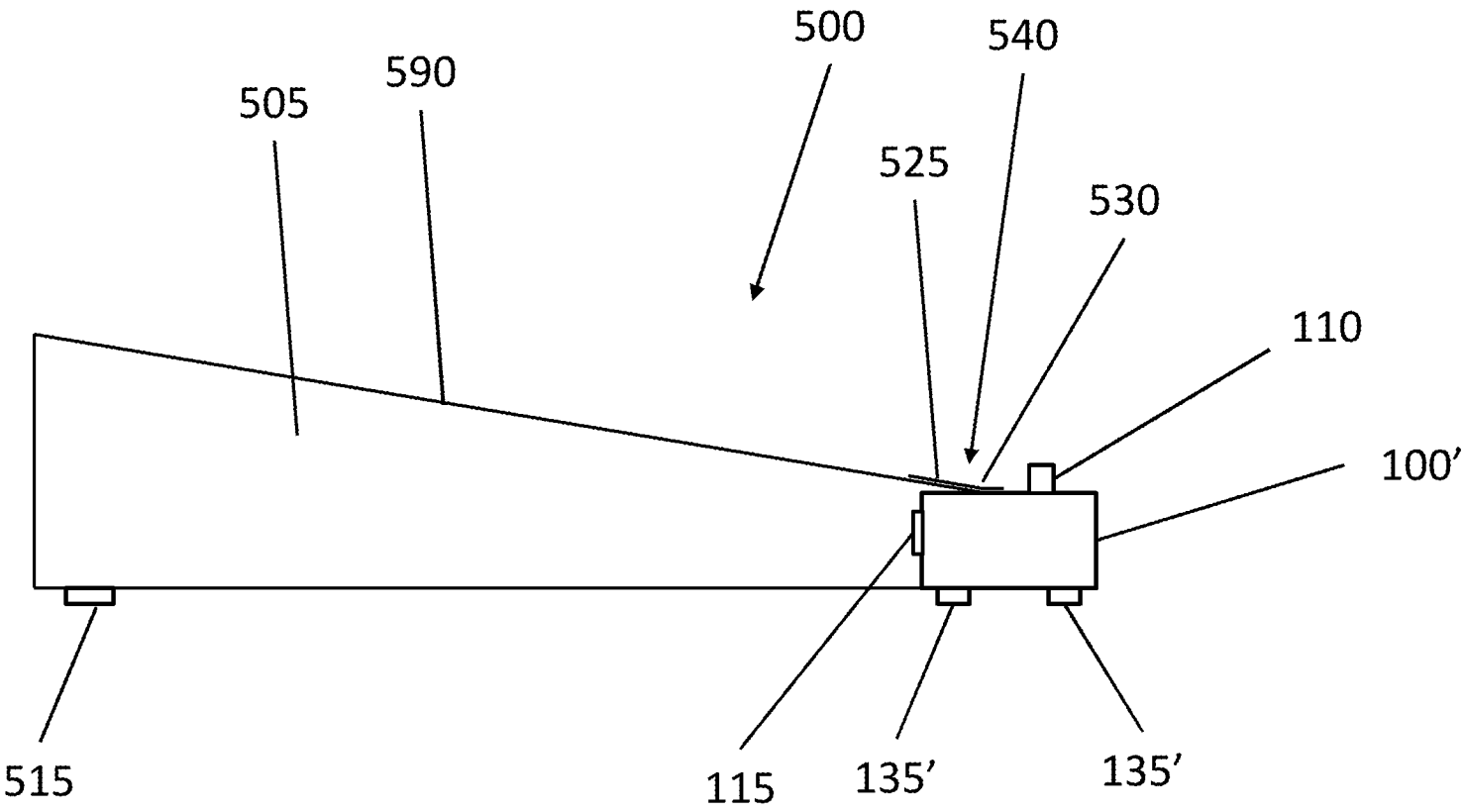
FIG. 5 illustrates a schematic side view of an exemplary pedal board with an attached pedal switching device in accordance with aspects of the present disclosure.

FIG. 5 illustrates a schematic side view of an exemplary pedal board assembly 500 having a pedal board 505 with an attached pedal switching device 100' in accordance with aspects of the present disclosure. As shown in FIG. 5, the pedal board switching device 100' is mounted to the pedal board 505 such that the jacks 115 are arranged towards a bottom side of the pedal board (e.g., underneath the top mounting surface 590). By implementing these aspects of the disclosure, the jacks 115 and associated cabling (not shown) can be arranged remotely (e.g., on the bottom side of the pedal board 505) from the pedal supporting surface 590 (e.g., the top side of the pedal board 505).

As shown in FIG. 5, the pedal switching device 100' is attached to the pedal board 505 such that the switches 110 are provided at a front end of the pedal board assembly 500. Moreover, as shown in FIG. 5, an upper surface of the pedal switching device 100' is approximately flush with (or slightly below) the pedal support surface 590 so that interference with pedals (not shown) arranged on the pedal board assembly 500 can be minimized. That is, when arranged in such a manner, the switches of the pedal switching device 100' are arranged at a lower height than pedals arranged on the pedal board 505. Thus, when a user attempts to access a pedal, the height of the pedal switching device 100' does not impede (or impedes to a lesser extent) access to the pedal arranged behind the pedal switching device 100'.

As also shown in FIG. 5, a connector 540 (e.g., attachment plate) may be used to attach the pedal switching device 100' to the pedal board 505. In embodiments, the connector may be contiguous with the pedal support surface (not shown), or the connector 540 may be a separate element attached to the pedal board 505. In embodiments, the connector 540 may be curved or angled (in side view) having a first portion 525 and a second portion 530 to transition from the angled arrangement of the pedal board to a surface approximately parallel to the ground, so that when the pedal switching device 100' is attached to the pedal board 505, the pedal switching device 100' will also be arranged approximately parallel to the ground. As shown in FIG. 5, when the pedal switching device 100' is attached, the support feet 135' for the pedal switching device 100' act as the front side support feet for the pedal board 505, and in conjunction with support feet 515, support the pedal board assembly 500 (e.g., off the ground and/or at a proper orientation).

Figure 6A:
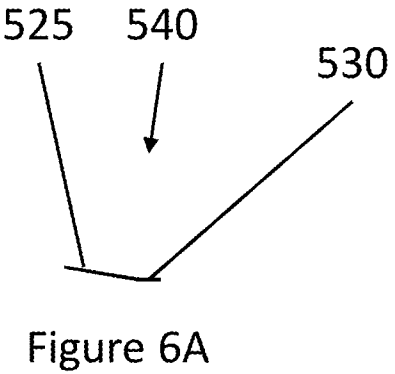
FIG. 6A schematically illustrates an exemplary mounting bracket configured to connect the pedal board with a pedal switching device in accordance with aspects of the present disclosure.

FIG. 6A illustrates a connector 540 (e.g., a mounting bracket) configured to connect the pedal board with a pedal switching device in accordance with embodiments of the present disclosure. As shown in FIG. 6A, the connector 540 may be curved or angled (in side view) having a first portion 525 and a second portion 530 to transition from the angled arrangement of the pedal board to a surface approximately parallel to the ground, so that when the pedal switching device 100' is attached to the pedal board 505, the pedal switching device 100' will also be arranged approximately parallel to the ground.

Figure 6B:
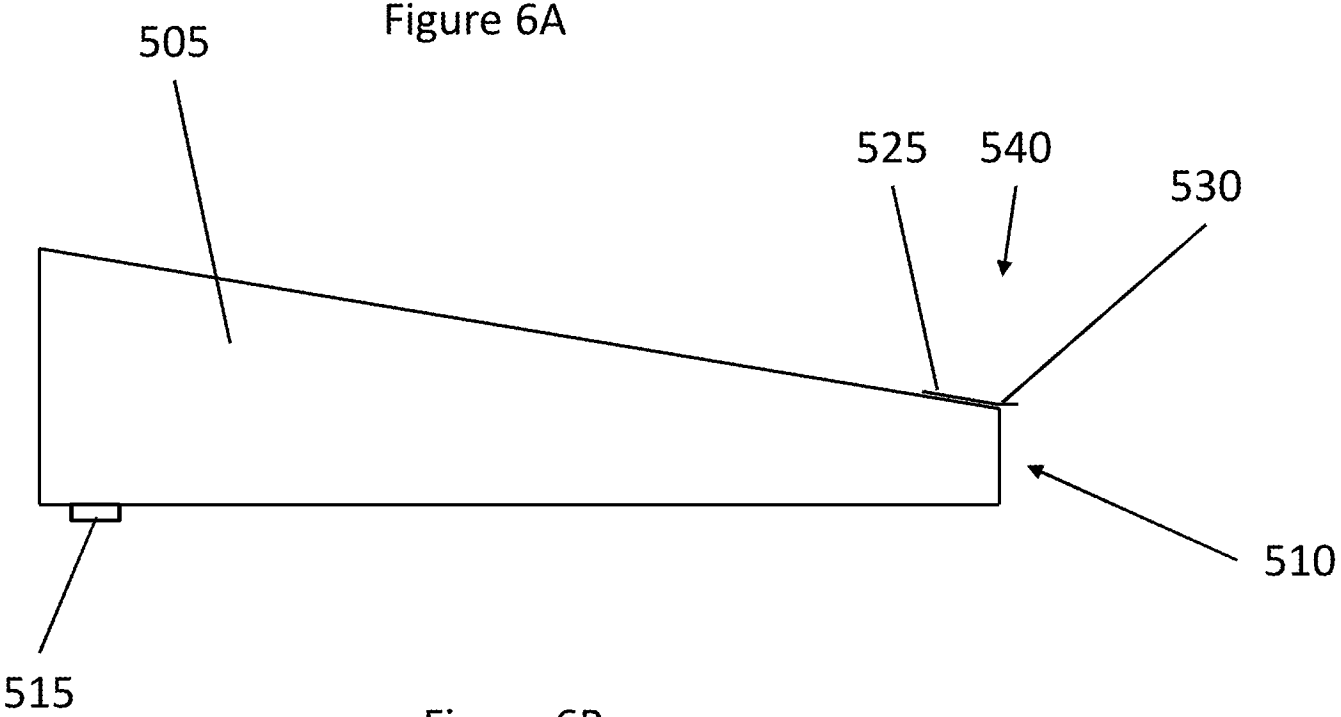
FIG. 6B illustrates a schematic side view of an exemplary pedal board with an attached mounting bracket in accordance with aspects of the present disclosure.

FIG. 6B illustrates a schematic side view of an exemplary pedal board 505 with a connector 540 (e.g., a mounting bracket) in accordance with aspects of the present disclosure. As shown in FIG. 6B, when the pedal switching device is removed, the receiving area 510 is exposed. As also shown in FIG. 6B, the connector 540 is arranged to overhang the front side of the pedal board 505 so as to be connectable to the pedal switching device (not shown). That is, the portion 530 of the connector 540 is arranged to overhang the front side of the pedal board 505 so as to be connectable to the pedal switching device (not shown).

Figure 7:
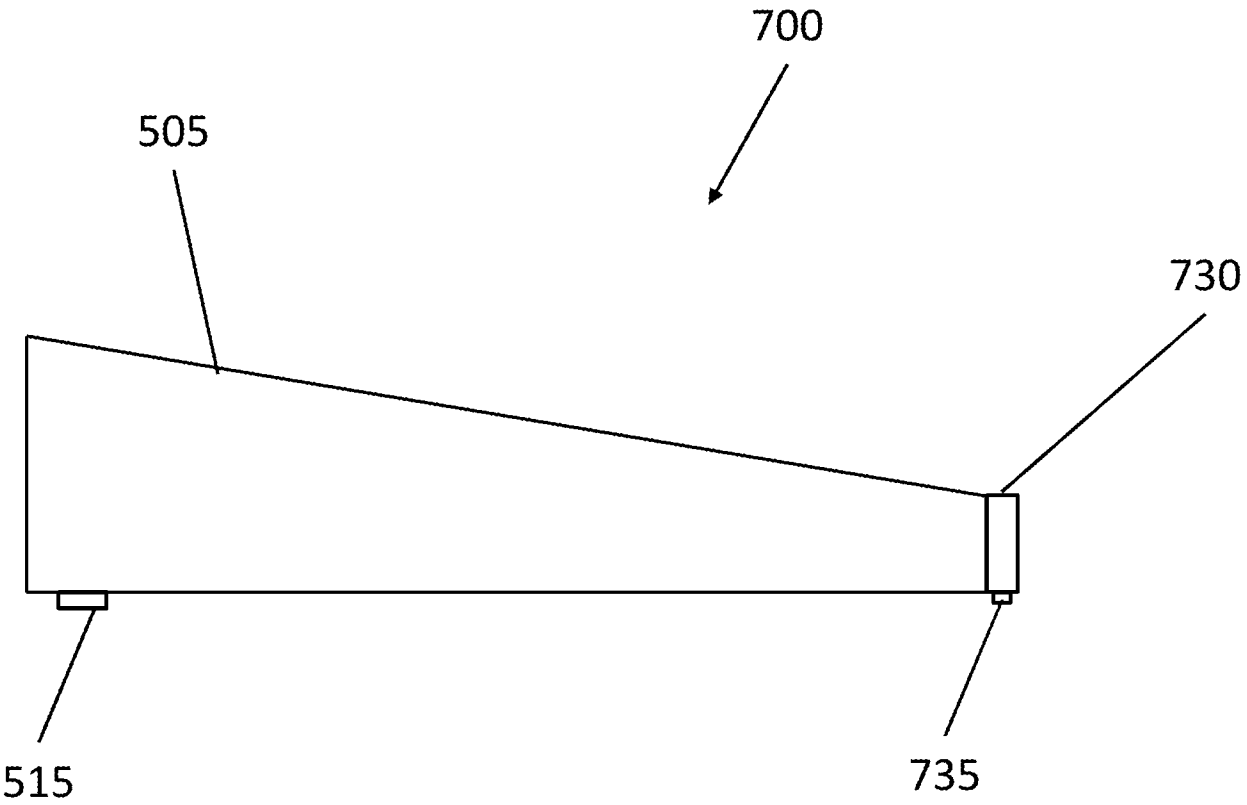
FIG. 7 illustrates a schematic side view of an exemplary pedal board with an attached front cover (e.g., in lieu of a pedal switching device) in accordance with aspects of the present disclosure.

FIG. 7 illustrates a schematic side view of an exemplary pedal board assembly 700 having a pedal board 505 with an attached front cover 730 (e.g., in lieu of a pedal switching device) in accordance with aspects of the present disclosure. As shown in FIG. 7, the front cover 730 has associated feet 735, and when the front cover 730 is attached to the pedal board 505, the feet 735 serve as front feet for the pedal board assembly 700, in accordance with aspects of the disclosure. In embodiments, the front cover 730 may be removably fastenable to the pedal board 505 using the same connections (e.g., fasteners) that are used to connect a switching device to the pedal board 505, in accordance with further aspects of the disclosure.

Figure 8:
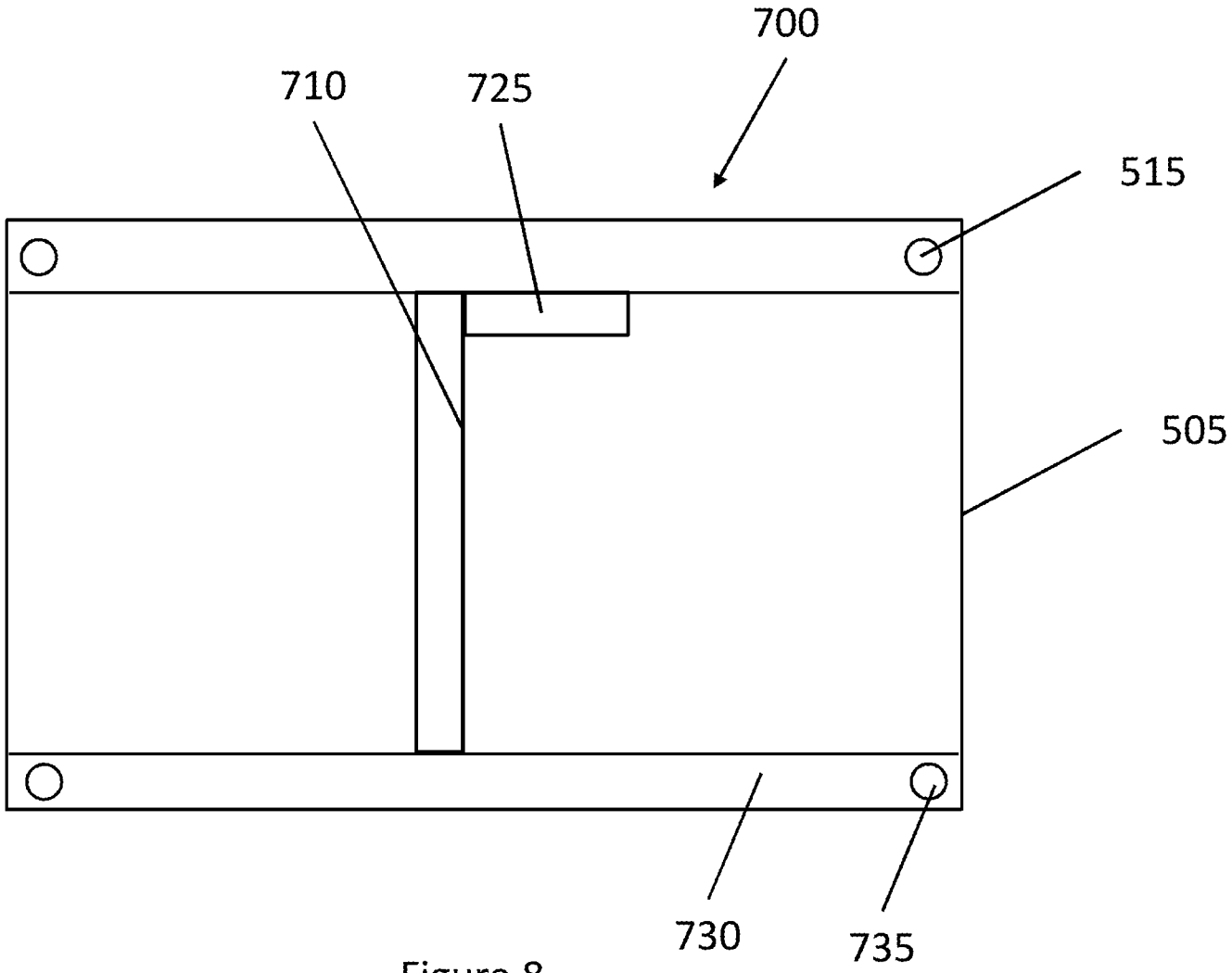
FIG. 8 illustrates a schematic bottom (or underside) view of an exemplary pedal board assembly including a pedal board and an attached front cover in accordance with aspects of the present disclosure.

FIG. 8 illustrates a schematic bottom (or underside) view of an exemplary pedal board assembly 700 having a pedal board 505 and an attached front cover 730 in accordance with embodiments of the present disclosure. As shown in FIG. 8, the pedal board includes at least one stiffening rib 710 (e.g., an L-shaped bracket) structured and arranged (e.g., fastened) on a bottom surface of the pedal board 505, and configured to provide additional stiffness to the support surface of the pedal board 505. As also shown in FIG. 8, one or more power supplies 725 (e.g., power conditioners) may be mounted to an underside of the pedal board 505, wherein the stiffening rib 210 is also configured to securely fasten the one or more power supplies 725 to the pedal board 505.

Figure 9:
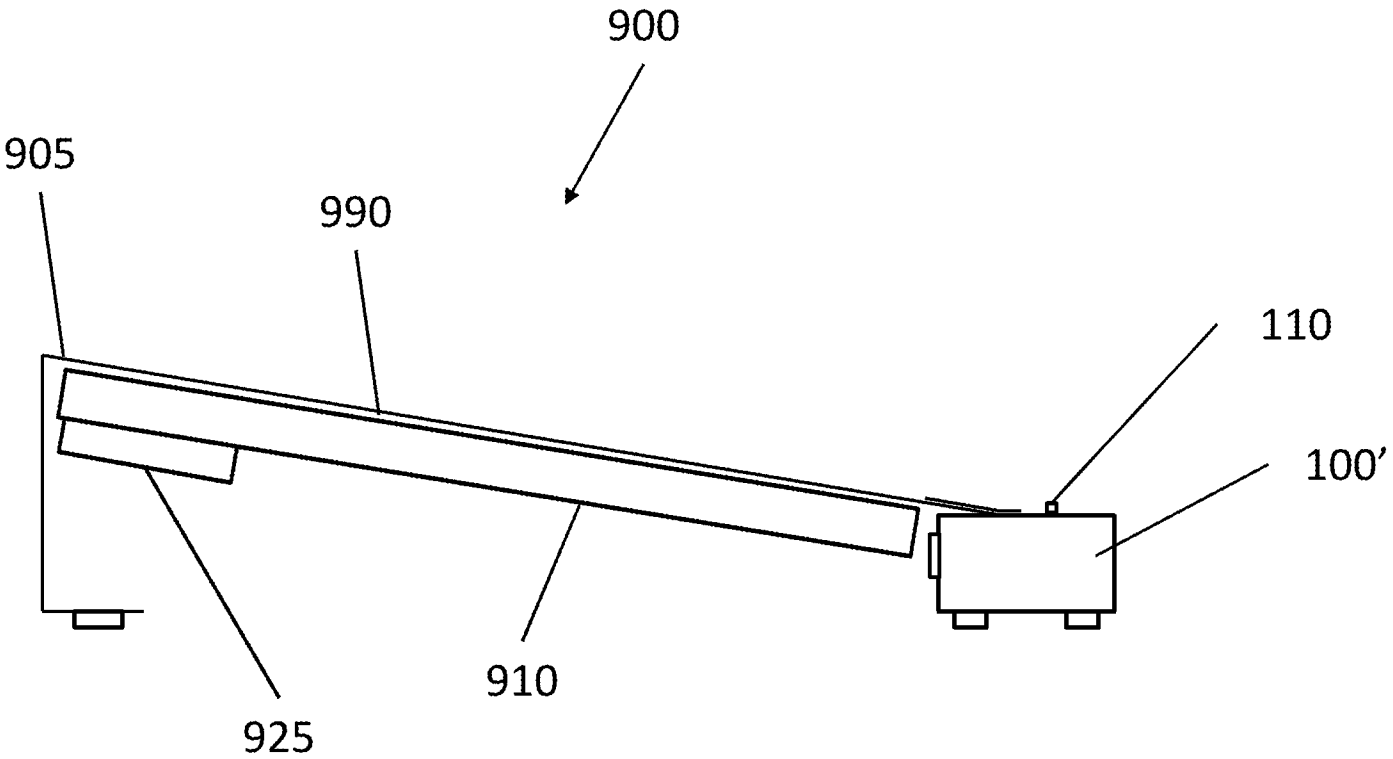
FIG. 9 illustrates a schematic side view of another exemplary pedal board with attached pedal switching device in accordance with further aspects of the present disclosure.

FIG. 9 illustrates a schematic side view of another exemplary pedal board assembly 900 having a pedal board 905 and an attached pedal switching device 100' in accordance with aspects of the present disclosure. As shown in this exemplary embodiment, the pedal board 905 may not have side walls, which may reduce the weight of the pedal board 905 and provide additional access passageways (e.g., for cabling). As shown in FIG. 9, a stiffening rib 910 is attached to an underside of the approximately planar support surface 990, and a power supply 925 is attached to an underside of the approximately planar support surface 990 and/or to the stiffening rib 910, so as to securely arrange the power supply 925.

Figure 10:
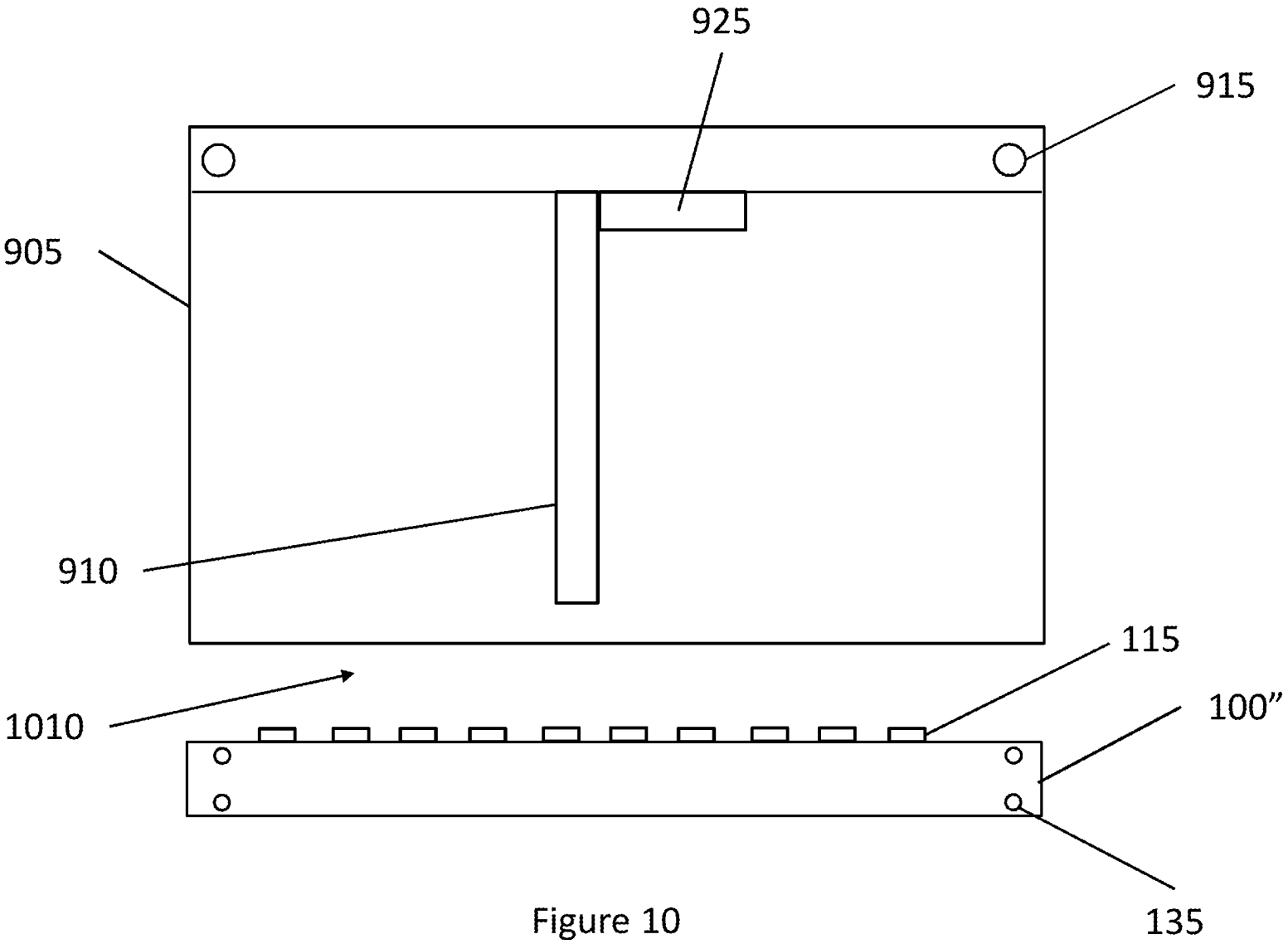
FIG. 10 illustrates a schematic bottom (or underside) view of an exemplary pedal board with an unattached pedal switching device in accordance with embodiments of the present disclosure.

FIG. 10 illustrates a schematic bottom (or underside) view of an exemplary pedal board 905 with an unattached pedal switching device 100" in accordance with embodiments of the present disclosure. As shown in FIG. 10, the pedal board 905 includes a receiving area 1010 structured and arranged to accommodate the unattached pedal switching device 100".

Figure 11:
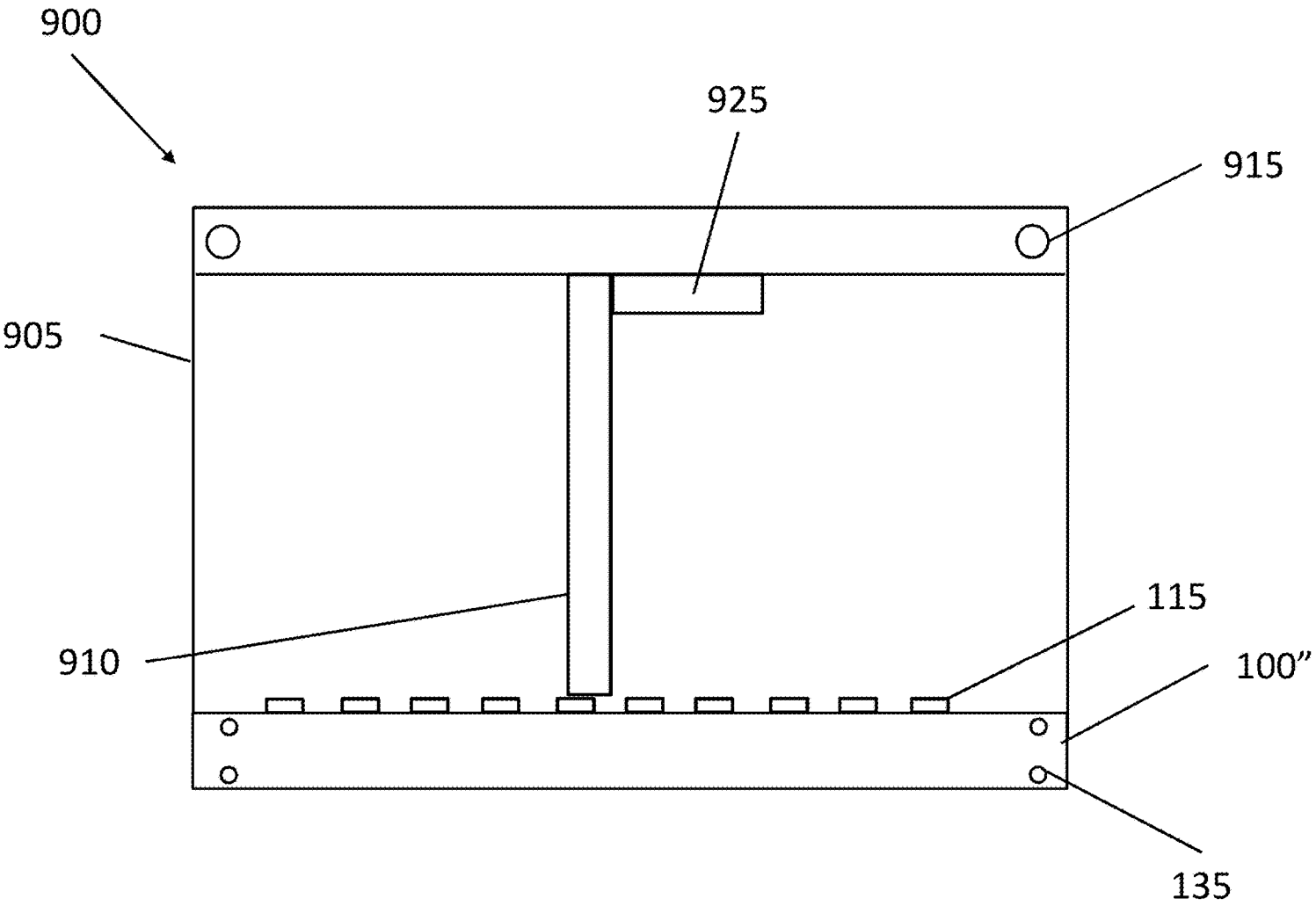
FIG. 11 illustrates a schematic bottom (or underside) view of an exemplary pedal board with an attached pedal switching device in accordance with embodiments of the present disclosure.

FIG. 11 illustrates a schematic bottom (or underside) view of an exemplary pedal board assembly 900 having a pedal board 905 and an attached pedal switching device 100" in accordance with embodiments of the present disclosure.

Figure 12:
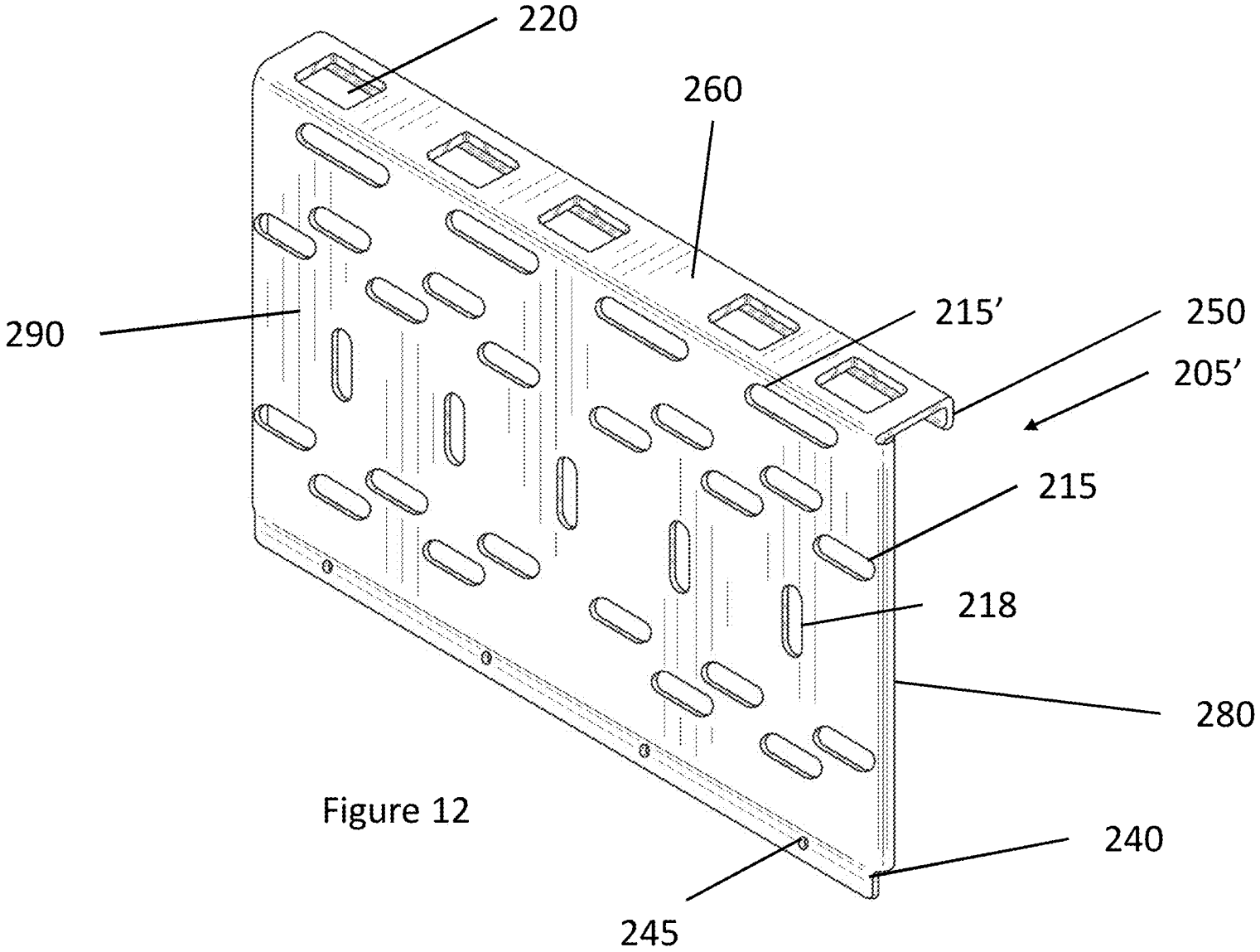
FIG. 12 is a perspective view of an exemplary pedal board in accordance an embodiment of the present disclosure.

FIG. 12 illustrates an exemplary perspective view of a pedal board 205' in accordance with aspects of the present disclosure. As shown in FIG. 12, the exemplary pedal board 205' includes an approximately planar surface 290 configured for mounting effects pedals thereto, and holes 215, 218 in the approximately planar surface 290 for routing cables (e.g., audio and/or power cables) between the top of the pedal board 205' and an underside of the pedal board 205'. As shown in FIG. 12, in embodiments, the holes include a plurality of horizontally-aligned obround holes 215 and a plurality of vertically-aligned obround holes 218. As can also be observed in FIG. 12, in certain embodiments, the pedal board 205' may also include a plurality of horizontally-aligned obround holes 215' (having a longer length than obround holes 215) arranged towards a rear side of the pedal board 205'. While FIG. 12 depicts an exemplary layout of horizontally-aligned obround holes 215 and a plurality of vertically-aligned obround holes 218, it should be understood that the depicted embodiment is exemplary, and other layouts of holes (e.g., more or less holes and/o differently shaped holes) are contemplated by the disclosure.

The pedal board 205' includes a rear wall 260 having a plurality of openings 220 therein, which are structured and arranged to allow, for example, power cables to pass there through so as to connect with a power supply (not shown). The pedal board 205' includes a rear support 250 extending from the rear wall 260, and configured to accommodate a plurality of feet (not shown) arranged on (e.g., fastened to) the rear support 250. In embodiments, the pedal board 205' also includes side walls 280 depending from the approximately planar surface 290. In embodiments, the rear wall 260, a rear support 250, and the side walls 280 may be formed contiguously with the approximately planar surface 290 of the pedal board 205'.

As shown in FIG. 12, a connector 240 is formed contiguously with the approximately planar surface 290 of the pedal board 205'. In embodiments, a pedal switching device (not shown) may be attached to the connector 240 using through holes 245 in the connector 240 configured to correspond with the locations of the fasteners of the pedal switching device (not shown).

As shown in FIG. 12, in embodiments, the connector 240 may be curved or angled (in side view) to transition from the angled arrangement of the pedal board 205' to a surface approximately parallel to the ground, so that when the pedal switching device (not shown) is attached thereto, the pedal switching device will also be arranged approximately parallel to the ground.

Figure 13:
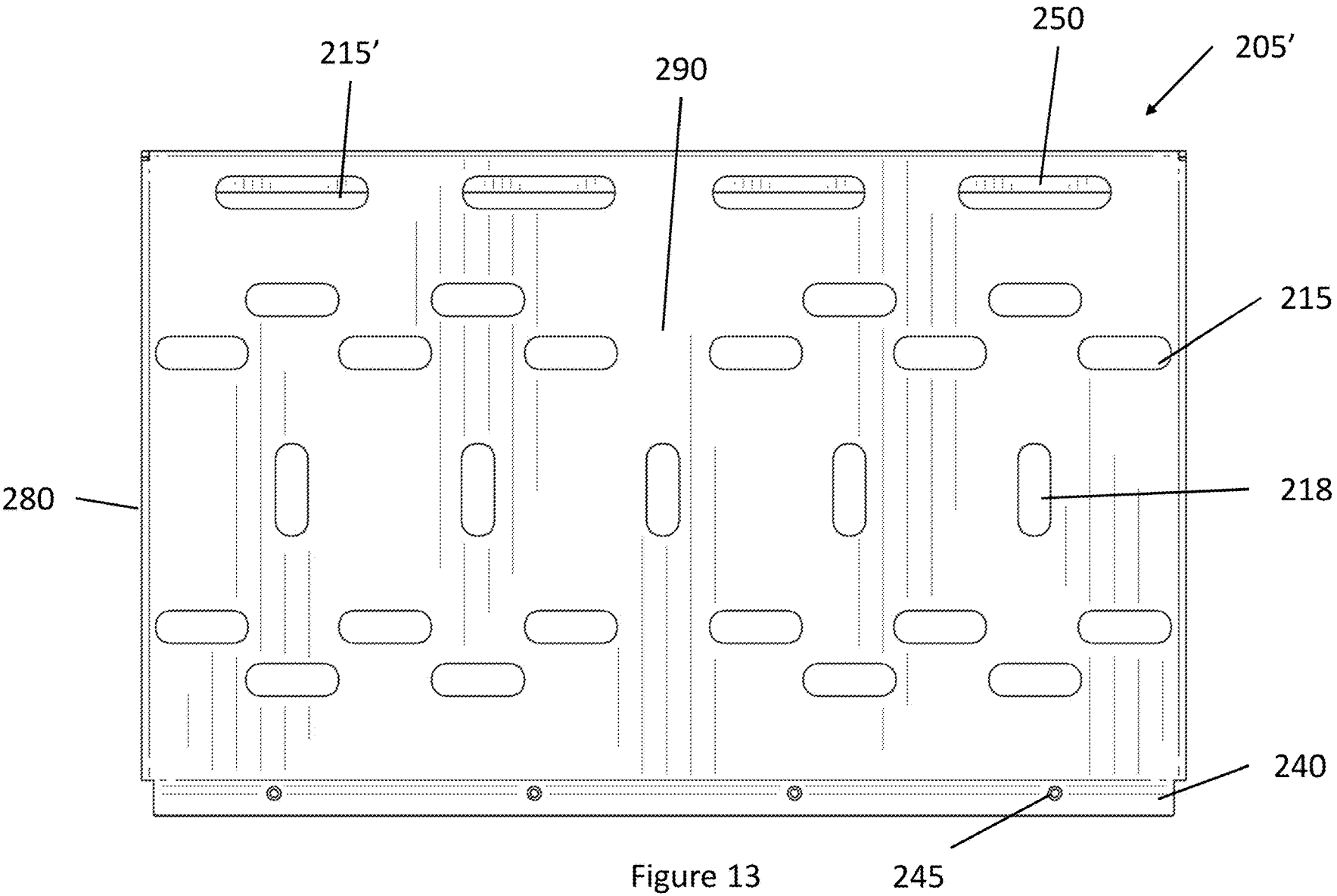
FIG. 13 illustrates a top view of the embodiment of FIG. 12 accordance an embodiment of the present disclosure.

FIG. 13 illustrates a top view of the embodiment of FIG. 12 in accordance with aspects of the present disclosure. As shown in FIG. 13, the exemplary pedal board 205' includes an approximately planar surface 290 configured for mounting effects pedals thereto, and holes 215, 218 in the approximately planar surface 290 for routing cables (e.g., audio and/or power cables) between the top of the pedal board 205' and an underside of the pedal board 205'. As shown in FIG. 13, in embodiments, the holes include a plurality of horizontally-aligned obround holes 215 and a plurality of vertically-aligned obround holes 218. As can also be observed in FIG. 13, in certain embodiments, the pedal board 205' may also include a plurality of horizontally-aligned obround holes 215' (having a longer length than obround holes 215) arranged towards a rear side of the pedal board 205'.

The pedal board 205' includes side walls 280 depending from the approximately planar surface 290. In embodiments, side walls 280 may be formed contiguously with the approximately planar surface 290 of the pedal board 205'. As shown in FIG. 13, a connector 240 is formed contiguously with the approximately planar surface 290 of the pedal board 205'. In embodiments, a pedal switching device (not shown) may be attached to the connector 240 using through holes 245 in the connector 240 configured to correspond with the locations of the fasteners of the pedal switching device (not shown).

Figure 14:
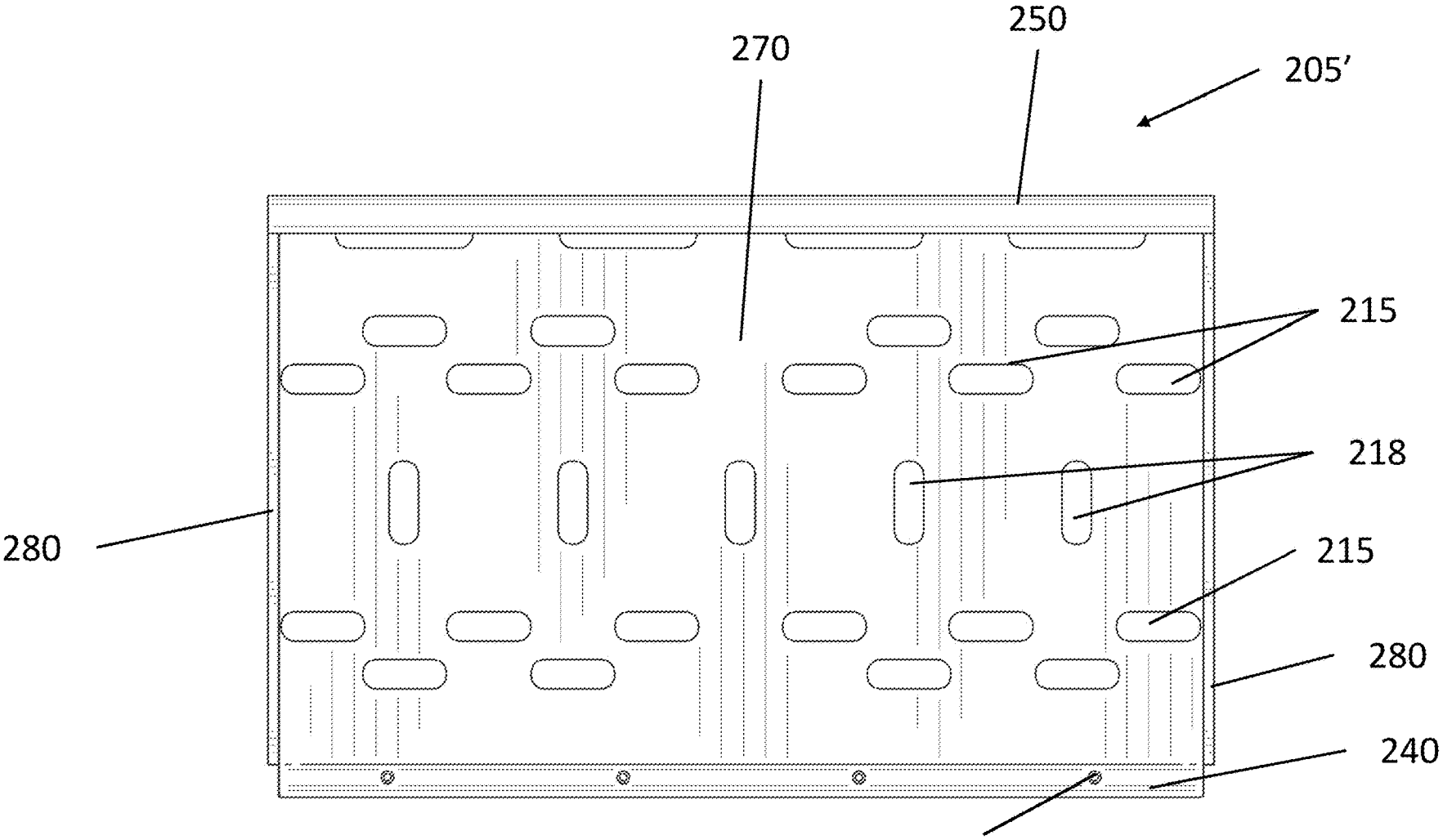
FIG. 14 illustrates a bottom view of the embodiment of FIG. 12 accordance an embodiment of the present disclosure.

FIG. 14 illustrates a bottom view of the embodiment of FIG. 12 in accordance with aspects of the present disclosure showing a bottom surface 270 of the approximately planar support. As shown in FIG. 14, the pedal board 205' includes a rear support 250 extending from the rear wall (not shown), and configured to accommodate a plurality of feet (not shown) arranged on (e.g., fastened to) the rear support 250. In embodiments, the pedal board 205' also includes side walls 280 depending from the approximately planar surface 290. In embodiments, the rear support 250, and the side walls 280 may be formed contiguously with the approximately planar surface of the pedal board 205'. A connector 240 is formed contiguously with the approximately planar bottom surface 270 of the pedal board 205'. In embodiments, a pedal switching device (not shown) may be attached to the connector 240 using through holes 245 in the connector 240 configured to correspond with the locations of the fasteners of the pedal switching device (not shown).

Figure 15:
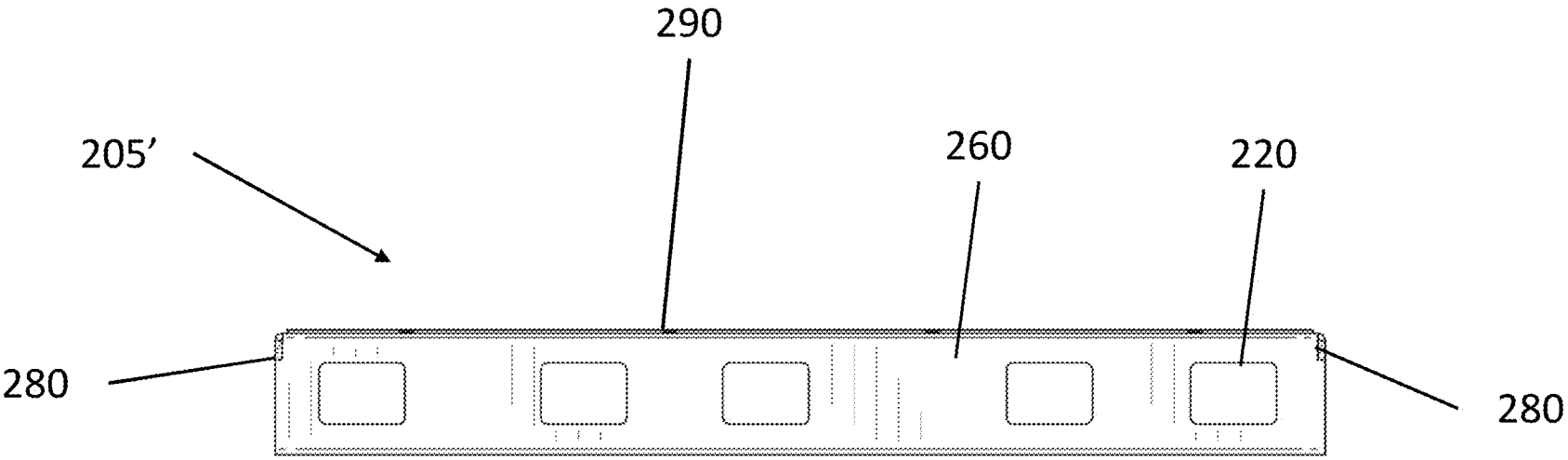
FIG. 15 illustrates a back view of the embodiment of FIG. 12 accordance an embodiment of the present disclosure.
Figure 16:
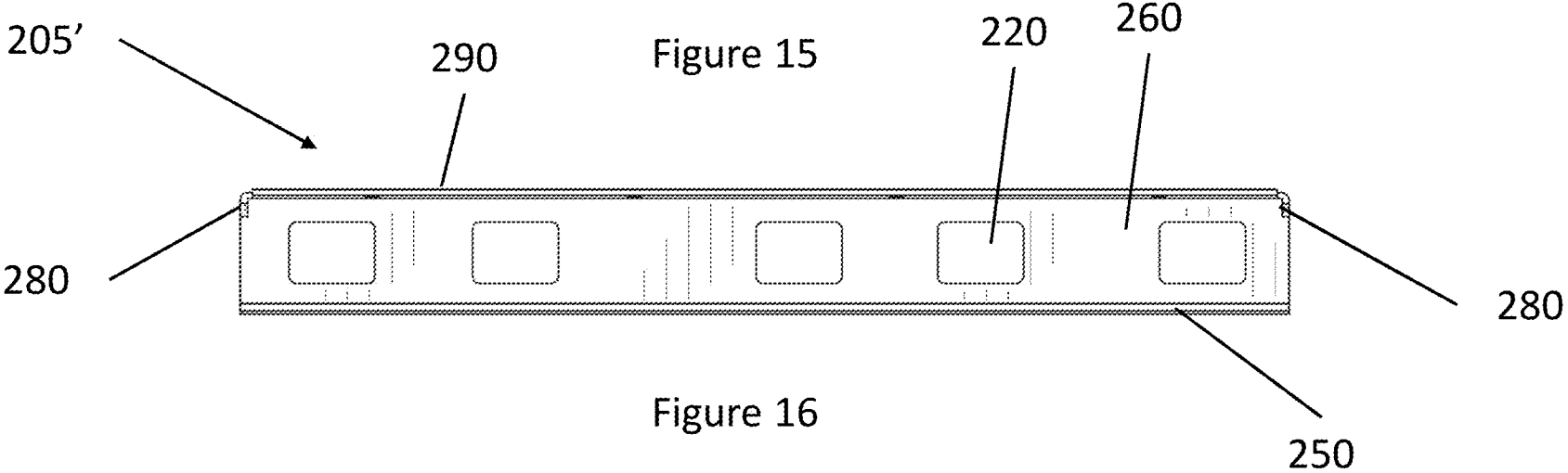
FIG. 16 illustrates a front view of the embodiment of FIG. 12 accordance an embodiment of the present disclosure.

FIGS. 15 and 16 illustrate back and front views of the embodiment of FIG. 12 in accordance with aspects of the present disclosure. As shown in FIGS. 15 and 16, the pedal board 205' includes a rear wall 260 having a plurality of openings 220 therein, which are structured and arranged to allow, for example, power cables to pass there through so as to connect with a power supply (not shown). As shown in FIG. 16, the pedal board 205' includes a rear support 250 extending from the rear wall 260, and may be configured to accommodate a plurality of feet (not shown) arranged on (e.g., fastened to) the rear support 250. In embodiments, the pedal board 205' also includes side walls 280 depending from the approximately planar surface 290. In embodiments, the rear wall 260, a rear support 250, and the side walls 280 may be formed contiguously with the approximately planar surface 290 of the pedal board 205'.

Figures 17A, 17B:
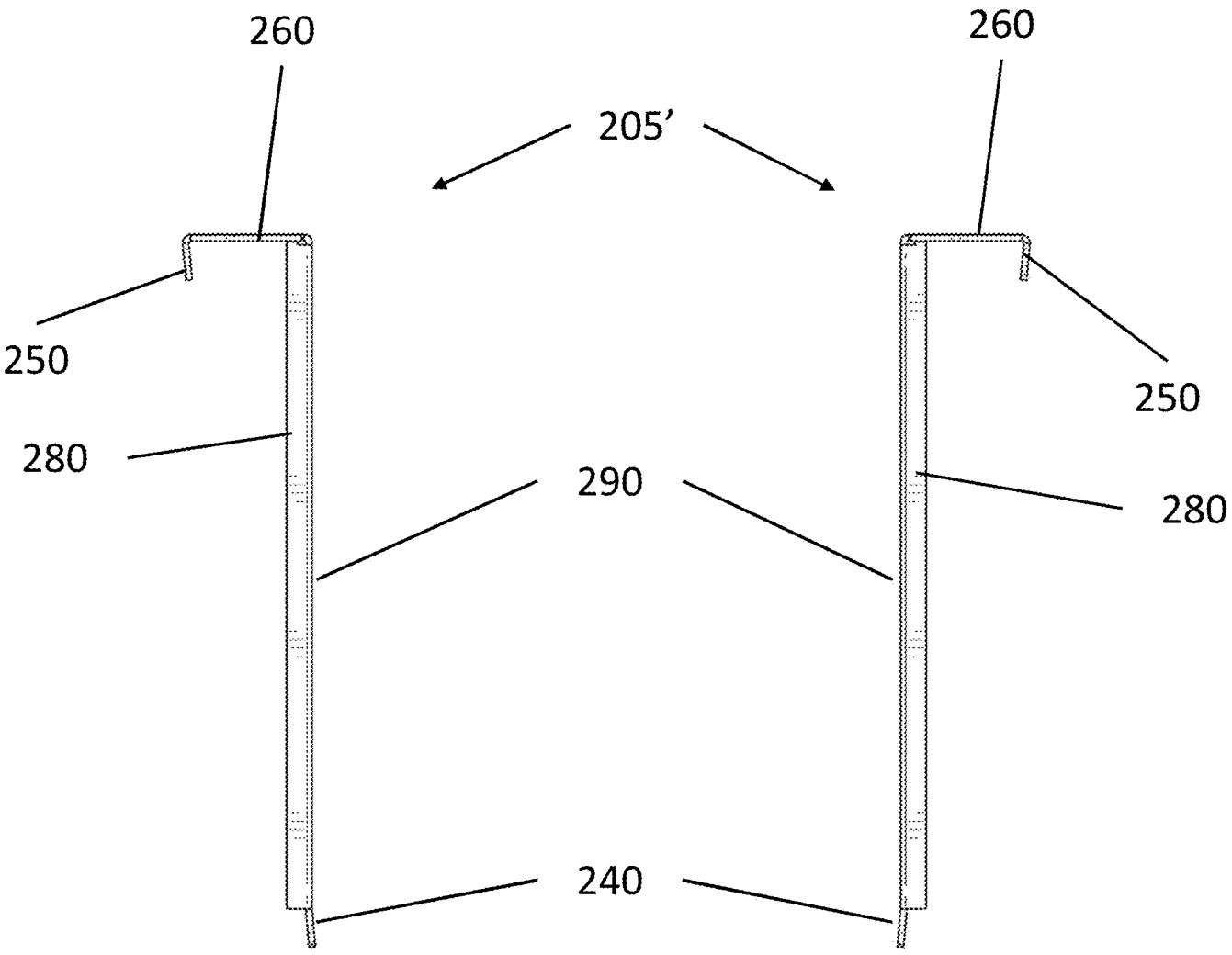
FIGS. 17A and 17B illustrate left and right side views of the exemplary embodiment of FIG. 12 accordance an embodiment of the present disclosure.

FIGS. 17A and 17B illustrate right and left side views of the embodiment of FIG. 12 in accordance with aspects of the present disclosure. As shown in FIGS. 17A and 17B, the pedal board 205' includes a rear wall 260 having a plurality of openings (not shown) therein, and includes a rear support 250 extending from the rear wall 260. In embodiments, the pedal board 205' also includes side walls 280 depending from the approximately planar surface 290. In embodiments, the rear wall 260, a rear support 250, and the side walls 280 may be formed contiguously with the approximately planar surface 290 of the pedal board 205'.

As also shown in FIGS. 17A and 17B, a connector 240 is formed contiguously with the approximately planar surface 290 of the pedal board 205'. In embodiments, a pedal switching device (not shown) may be attached to the connector 240 using through holes (not shown) in the connector 240 configured to correspond with the locations of the fasteners of the pedal switching device (not shown). As shown in FIGS. 17A and 17B, in embodiments, the connector 240 may be curved or angled (in side view) to transition from the angled arrangement of the pedal board 205' to a surface approximately parallel to the ground (when the pedal board assembly including switching device is placed on horizontal surface), so that when the pedal switching device (not shown) is attached thereto, the pedal switching device will also be arranged approximately parallel to the ground. As shown in FIGS. 17A and 17B, in embodiments, the connector 240 is approximately parallel to the rear support 250 extending from the rear wall 260.

Figure 18:
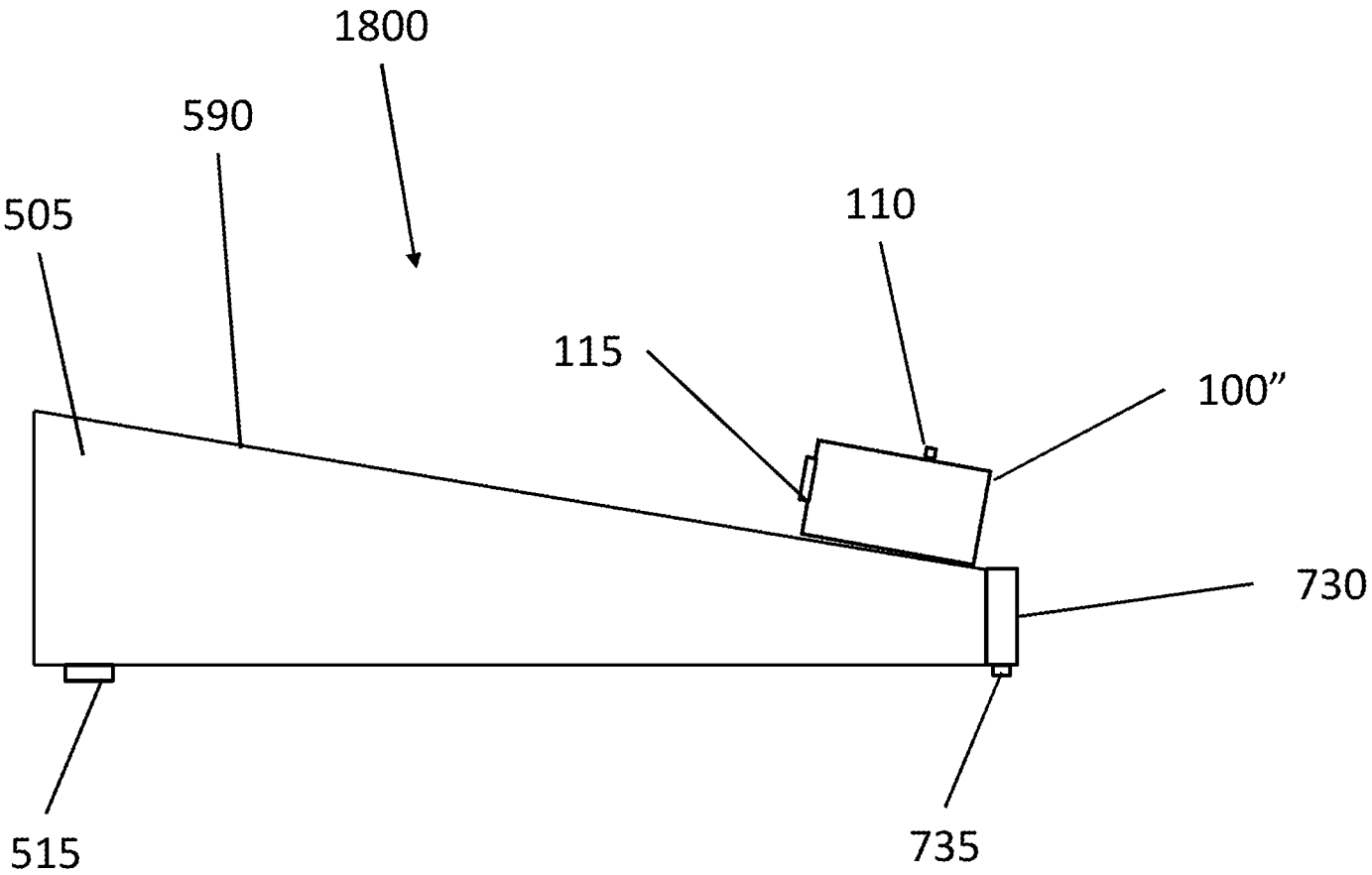
FIG. 18 illustrates a schematic side view of an exemplary pedal board with attached pedal switching device mounted on a top surface of the pedal board.

FIG. 18 illustrates a schematic side view of an exemplary pedal board assembly 1800 having a pedal board 505 with an attached pedal switching device 100" mounted on a top surface 590 of the pedal board 505. As shown in FIG. 18, with the pedal switching device 100" mounted on a top surface 590 of the pedal board 505, the pedal board "real estate" (or the area for accommodating effects pedals) is reduced. For example the pedal switching device 100" itself takes up real estate, and the cables (not shown) inserted into the jacks 115 on the backside of the pedal switching device 100" will also require some clearance, thus taking up additional pedal board real estate on the top surface 590 of the pedal board 505. Additionally, with such an arrangement, the pedal switching device 100" (e.g., the height of the pedal switching device 100") renders access to any pedals arranged behind the pedal switching device 100" more difficult.

With reference again to FIG. 9 (and in comparison to the exemplary arrangement of FIG. 18), by implementing aspects of the disclosure, the problem of pedal switching devices (or pedal switchers) taking up too much real estate on the pedal board is solved by moving all the jacks 115 to the underside of the pedal board 905. Also, the foot switches 110 on the pedal switching device 100" are lower relative to the pedals mounted (not shown) on the board, which, in accordance with aspects of the disclosure, improves access and allows a user to mount pedals very close to the front while still allowing access to all switches (e.g., the pedal switches and the bank switches 110 on the pedal switching device 100").

Figure 19:
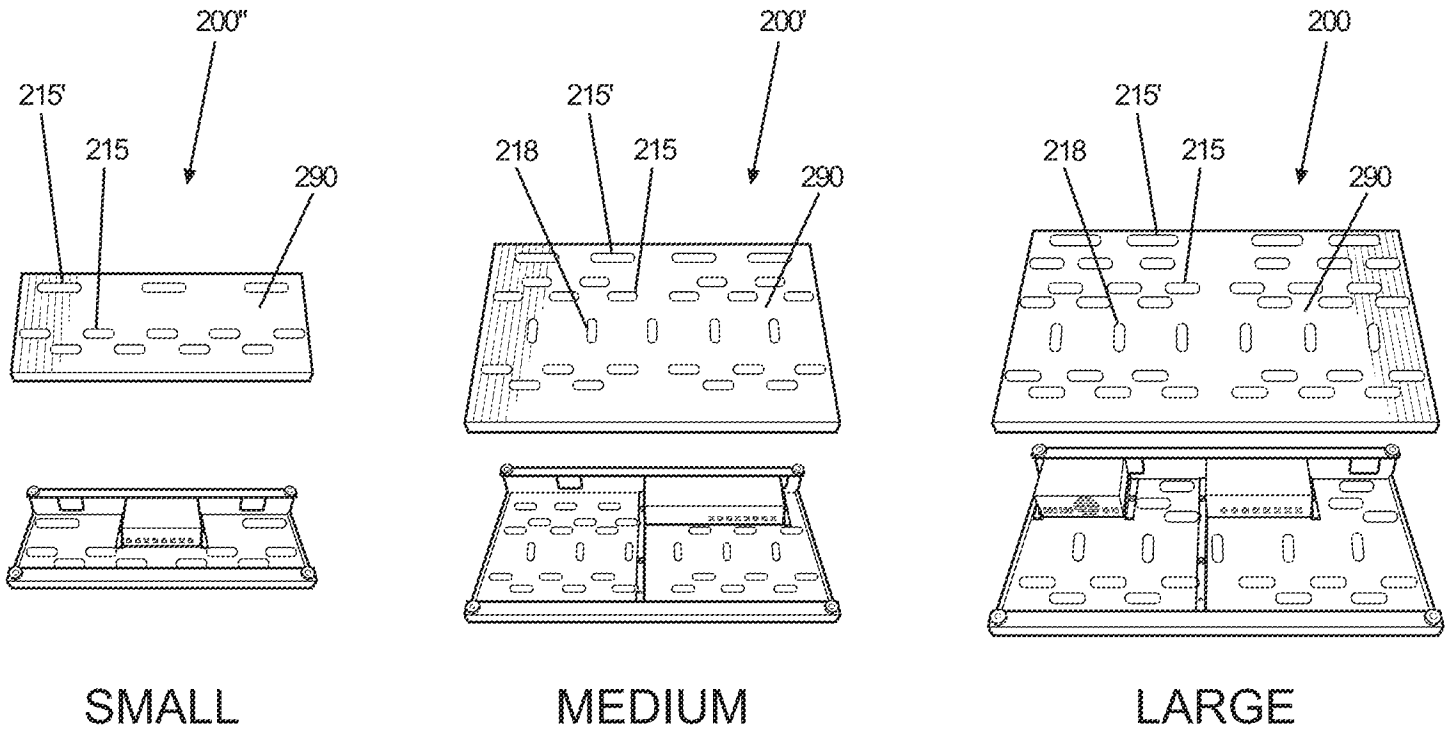
FIG. 19 shows various perspective views pedal boards configured with different size support surfaces in accordance with embodiments of the present disclosure.

FIG. 19 shows exemplary pedal boards 200, 200', and 200" configured with different size support surfaces 290 in accordance with embodiments of the present disclosure. As shown in FIG. 19, in embodiments, the pedal board may be configured in different sizes. As should be understood, for example, with a smaller pedal board 200" or with a medium board 200', a corresponding switching device (not shown) would be configured (e.g., reduced in size) to be receivable in (or on) the smaller pedal board 200" or the medium board 200'.

As also shown in FIG. 19, the differently-sized boards may include different arrangements of holes 215, 218, and 215', wherein some pedal boards (e.g., pedal board 200") may, for example, not include vertically-oriented obround holes 218.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

Accordingly, the present disclosure provides various systems, structures, methods, and apparatuses. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular materials and embodiments, embodiments of the invention are not intended to be limited to the particulars disclosed; rather the invention extends to all functionally equivalent structures, methods, and uses such as are within the scope of the appended claims.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. A pedal board assembly, comprising:

a pedal board having a pedal board surface structured and arranged to support a plurality of effects pedals; and a removable pedal switching system, wherein-the pedal switching system is operable to selectively activate each of a plurality of effect loops of the pedal switching system to selectively insert one or more of the plurality of effect devices into an instrument signal path, wherein the pedal board includes a receiving area structured and arranged to accommodate the pedal switching system, wherein the pedal board includes the pedal board surface, a rear wall depending from a rear of the pedal board surface, a rear support extending from the rear wall and under the pedal board surface, a connection area extending from a front of the pedal board surface, and side walls extending from the sides of the pedal board surface, wherein the pedal board surface, the rear wall, the rear support, the connection area and the side walls are formed as a monolithic structure, and wherein the rear support together with the pedal switching system support the pedal board assembly on a supporting surface.

2. The pedal board assembly of claim 1, wherein the receiving area is at a front of the pedal board.

3. The pedal board assembly of claim 1, wherein the pedal board further comprises a support rib structured and arranged to support the pedal board surface.

4. The pedal board assembly of claim 1, wherein the rear surface includes at least one opening structured and arranged for passing cabling there through.

5. The pedal board assembly of claim 4, further comprising at least one power supply having a socket, fastened to an underside of the pedal board such that the socket aligns with one of the at least one opening.

6. The pedal board assembly of claim 1, wherein the pedal board surface includes a plurality of openings structured and arranged for passing cabling there through.

7. The pedal board assembly of claim 6, wherein the openings have an obround shape.

8. The pedal board assembly of claim 7, wherein the openings comprise horizontally-aligned obround openings and vertically-aligned obround openings.

9. The pedal board assembly of claim 1, wherein the pedal board has a pedal board width, and the pedal switching system has a pedal switching system width, and the pedal board width is approximately the same as the pedal switching system width.

10. The pedal board assembly of claim 1, wherein the pedal switching system is arranged in the receiving area.

11. The pedal board assembly of claim 1, wherein the pedal switching system comprises a plurality of switches on an upper surface thereof, and a plurality of connection jacks on a rear surface thereof, and wherein when the pedal switching system is arranged in the receiving area, the plurality of connection jacks are arranged underneath the pedal board surface.

12. The pedal board assembly of claim 1, wherein the connection area includes through holes, wherein the pedal switching system comprises threaded holes arranged to cooperate with the through holes when the pedal switching system is arranged in the receiving area, and wherein the pedal switching system is fastenable to the connection area using the through holes and the threaded holes.

13. The pedal board assembly of claim 1, wherein the connection area includes through holes, and wherein the connection area is angularly arranged with respect to the pedal board surface.

14. A pedal board assembly, comprising:

a pedal board having a pedal board surface structured and arranged to support at least one effect pedal; and a removable pedal switching system, wherein the pedal board includes a receiving area structured and arranged to accommodate the pedal switching system, the pedal board assembly further comprising a front support structured and arranged to be accommodatable within the receiving area in place of the removable pedal switching system.

15. A pedal board, comprising:

a pedal board surface structured and arranged to support at least one effect pedal;

a rear wall depending from a rear of the pedal board surface;

a rear support extending from the rear wall and under the pedal board surface, and structured and arranged to support a rear end of the pedal board;

a connection area extending from a front of the pedal board surface; and a receiving area underneath the connection area, wherein the receiving area is structured and arranged to accommodate a removable front support and, alternatively accommodate a removable pedal switching system, wherein the pedal switching system is operable to selectively activate each of a plurality of effect loops of the pedal switching system to selectively insert one or more of the plurality of effect devices into an instrument signal path, and wherein the pedal board surface, the rear wall, the rear support, and the connection area are formed as a monolithic structure.

16. The pedal board of claim 15, wherein the rear support is approximately parallel to the connection area.

17. A pedal board assembly, comprising:

a pedal board having a pedal board surface structured and arranged to support at least one effect pedal, a rear wall depending from a rear of the pedal board surface, a rear support extending from the rear wall and under the pedal board surface, a connection area extending from a front of the pedal board surface, and side walls extending from the sides of the pedal board surface; and a removable pedal switching system, wherein the pedal switching system is operable to selectively activate each of a plurality of effect loops of the pedal switching system to selectively insert one or more of the plurality of effect devices into an instrument signal path, wherein the pedal board includes a receiving area at a front of the pedal board structured and arranged to accommodate the pedal switching system, wherein the pedal board has a pedal board width, and the pedal switching system has a pedal switching system width, and the pedal board width is approximately the same as the pedal switching system width, wherein the removable pedal switching system is fastenable in the receiving area using the connection area, wherein the rear support together with the pedal switching system support the pedal board assembly on a supporting surface, and wherein the pedal board surface, the rear wall, the rear support, the connection area, and the side walls are formed as a monolithic structure.

* * * * *